US005575072A

United States Patent [19]

Eldridge

[11] Patent Number: 5,575,072

[45] Date of Patent: Nov. 19, 1996

[54] ELECTRIC ARCHERY BOW SIGHT/RANGE FINDER

[76] Inventor: Gary Eldridge, 1617 Sierraville Ave., San Jose, Calif. 95132

[21] Appl. No.: 335,989

[22] Filed: Nov. 8, 1994

[51] Int. Cl.[6] ..... F41G 1/467

[52] U.S. Cl. ..... 33/265; 124/87

[58] Field of Search ..... 33/241, 242, 243, 33/265, 284; 124/87

[56] References Cited

U.S. PATENT DOCUMENTS

| | | | |
|---|---|---|---|
| 3,696,517 | 10/1972 | Larson | 33/265 |
| 3,766,656 | 10/1973 | Westphal | 33/265 |
| 3,945,127 | 3/1976 | Spencer | 33/265 |
| 4,481,717 | 11/1984 | Kowalski | 124/87 |
| 4,617,741 | 10/1986 | Bordeaux et al. | 33/265 |
| 4,984,372 | 1/1991 | Blizzard | 33/265 |

*Primary Examiner*—William A. Cuchlinski, Jr.
*Assistant Examiner*—G. Bradley Bennett

[57] ABSTRACT

This invention relates to a sight targeting and range finding device which permits the bow to be aligned properly to a destined target. The bow sight-range finder device can be programmed by the user to select the proper targeting marker for a given distance and also allow selection of range finder markers that can be programmed to be used in conjunction with the targeting markers. When the range finder is used by the archer, the site targeting markers are automatically positioned. The bow sight includes a control which provides interface between the bow sight electronic circuitry and the archers fingers on the hand holding the bow.

14 Claims, 7 Drawing Sheets

Fig. 6
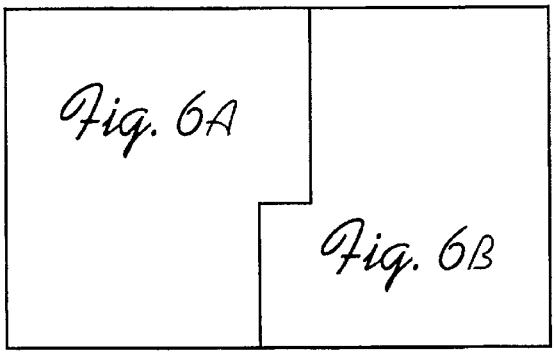
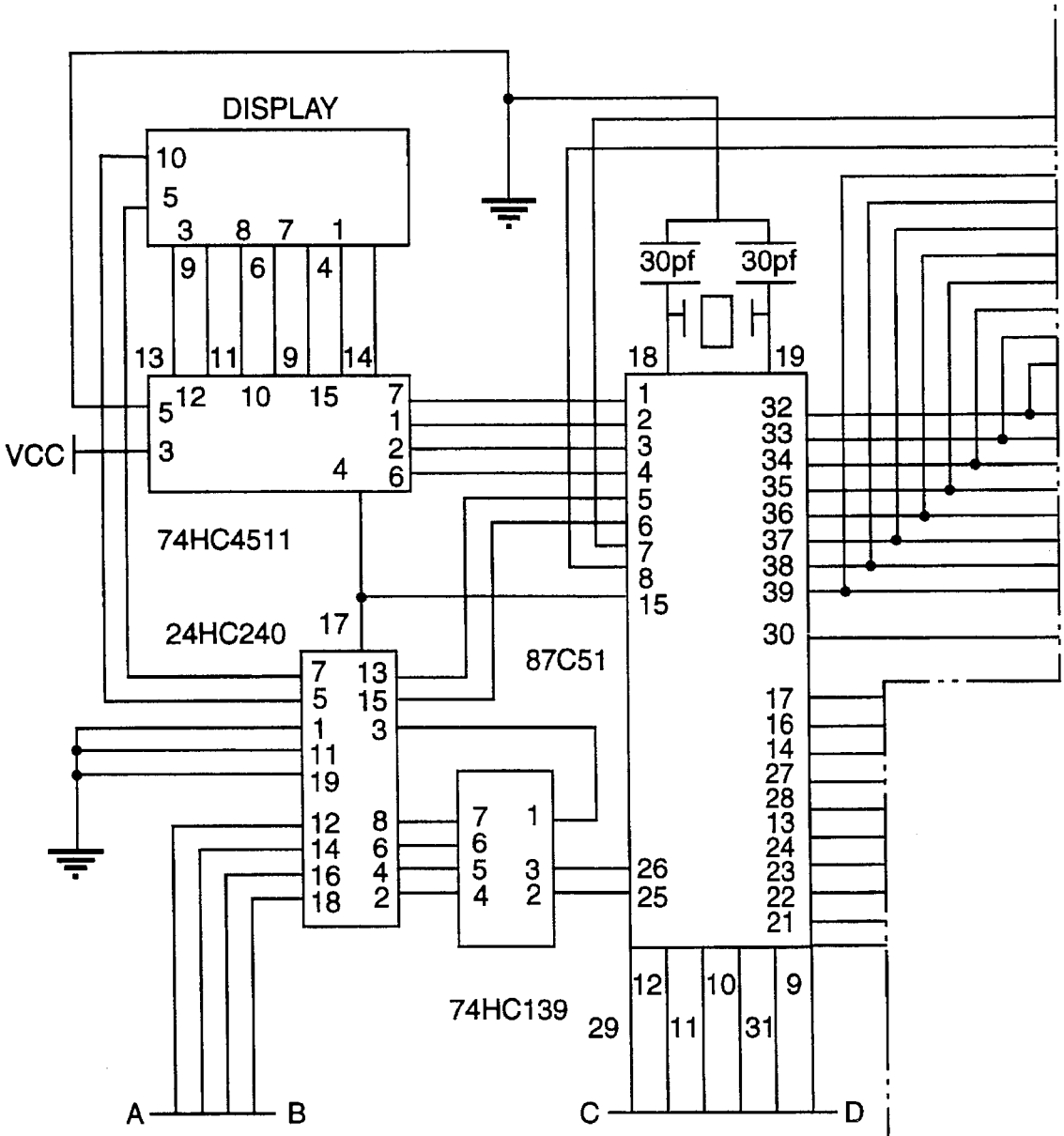
Fig. 6A

ELECTRIC ARCHERY BOW SIGHT/RANGE FINDER

BACKGROUND

Archery has many factors which effect trajectory and impact point of an arrow at a given distance. An adjustable means that is easily accessible and easy to use for the archer to identify distance and impact point of arrow at said distance is needed. The trajectory variance from archer to archer is unique enough to require a sight targeting device and, a range finder device which can be programmed by the archer with multiple site targeting markers and desired range finder markers for their own bow and arrow setup and preferred target size. Thus there are needs for a range finding device that can work in conjunction with a sight targeting device and the device needs to allow the archer to program multiple settings for the range finder that can be set for the preferred target size and the device needs to allow the archer to program multiple settings for the sight targeting device that can be used with or without the range finder device.

There is a patent which relates to an electronic range finder that works solely as a range finder. The device is limited to 4 target sizes through 4 manual switches. The patent which describes this range finder is Bordeaux and Ward, U.S. Pat. No. 4,617,741 (1986).

SUMMARY OF THE INVENTION

This invention relates to a sight targeting and range finding device which permits the bow to be aligned properly to a destined target. The bow sight includes a sight targeting means which can work in conjunction with or without a range finding means. When the range finder means is used by the archer, the site targeting means is automatically positioned. The bow sight further includes a control means which provides interface between the bow sight electronic circuitry and the archers fingers on the hand holding the bow. Said circuitry provides programmable ability for the archer which can be retrieved at a future time. 1ST said program ability comprises of sight targeting distance markers which will be referenced as either sight targeting marker or distance marker throughout this document, and can be chosen and programmed by the archer by utilization of said control means. Markers will identify arrow impact at given distance since markers will be identified by the archer through attempted arrow shots at given distances by visually placing the marker on the targets point of arrow impact and changing distance marker until arrow to target alignment is achieved. Distance markers will be a reflected light which will be visual to the archer off of a transparent window, but not limited to a transparent window, a vertical reflective bar or like means in place of the transparent window can also be used. 2ND said program ability comprises of decimal numeric displays to be chosen by the archer through said control means to correspond to said distance markers. 3RD said program ability comprises of range finder markers which can be chosen by the archer through said control means to be used with said distance markers. Range finder markers are reflected light which will be visual to the archer off of said transparent window. At time of selection of range finder marker, the selected distance marker is visually placed on top of the target while range finder marker is visually placed at the bottom of the target, or vice versa. Said range finder marker in conjunction with said distance marker as described herein, outlines range finding method.

The bow sight further includes the ability to recall said programmed distance marker and said programmed range finder marker and said programmed digital numeric display through utilization of said control means. Locating appropriate said distance marker to be used for said arrow to target alignment method will be done by scanning said programmed markers through said control means by using said range finding method described herein. Locating appropriate said programmed distance marker can also be done by scanning programmed digital numeric display for known distance through said control means to recall proper sight targeting marker. The bow sight further includes the ability through said control means to turn off both said distance and range finder markers and said numeric digital display for standby purposes to save battery life. Activating the bow sight through said control means from standby mode will display said markers and said numeric digital display as they were prior to said standby mode activation.

BRIEF DESCRIPTION OF THE DRAWINGS

FIGS. 6A and 6B show the circuitry design of the sight targeting and range finding device and FIG. 6 shows how FIG. 6A and 6B are placed together.

FIG. 7A and 7B are placed together.

DESCRIPTION OF THE PREFERRED EMBODIMENT

Figure 1:
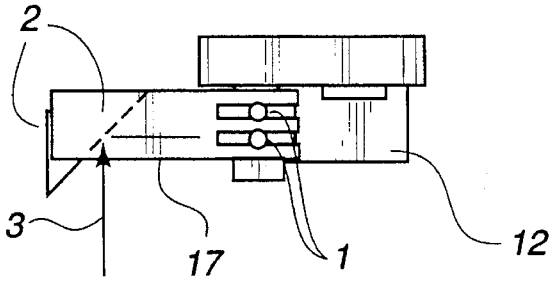
FIG. 1 is a top view of the range finder and sight targeting device.

Physical description will now be given in reference to FIG. 1

There will be a transparent viewing window that will be used to reflect light markers from underneath cover 12 to the archer whom will be viewing from position 3. The reflector 2 will be at a 45 degree angle in reference to light marker source in order to reflect said light markers at a 90 degree angle to the archer. Bracket 17 will provide support for the transparent viewing window 2 and can vary windage position by use of adjustment screws 1.

Physical description will now be given in reference to FIG. 2

Battery power source 5 will provide power to circuitry which is encapsulated in epoxy 16 through power switch 9. A numeric display 4 will be provided to reveal distance of archers target and will correspond to sight targeting marker 6 which is a reflected light from transparent window 2. Range finder marker 7 will be used by placing sight targeting marker 6 on top of the target while placing range finder marker 7 at the bottom of the target. The sight targeting marker 6 and the range finder marker 7 will both be aligned to the target in reference to windage line 20 which will visually be placed in the center of the target. The control of said circuitry is done through the up button 10 and or down button 11. To program said circuitry, switch 8 must be turned on, then up button 10 and or down button 11 can be used to do the programming.

Physical description will now be given in reference to FIG. 3 and FIG. 2

Figure 2:
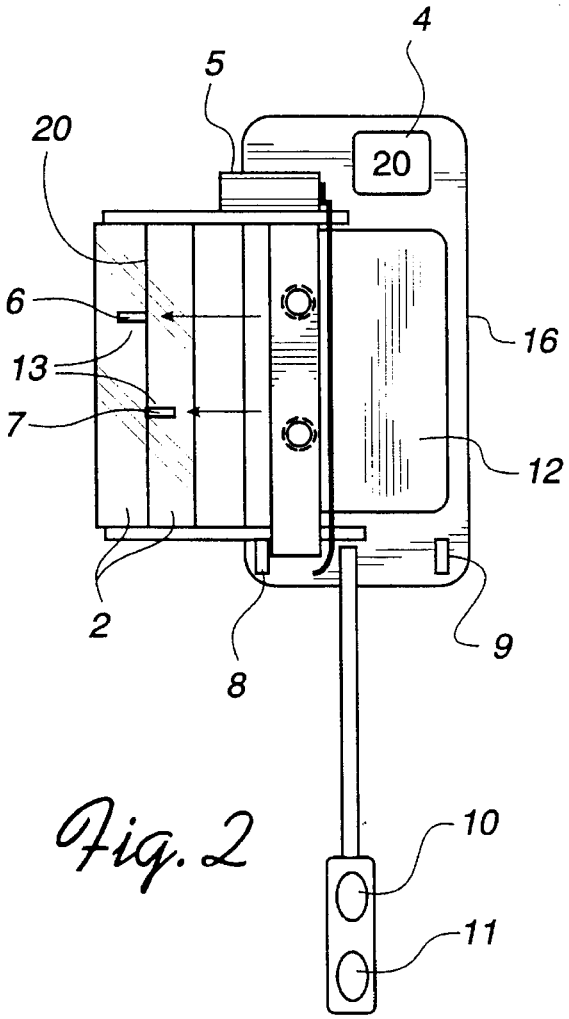
FIG. 2 is a front view of the range finder and sight targeting device.
Figure 3:
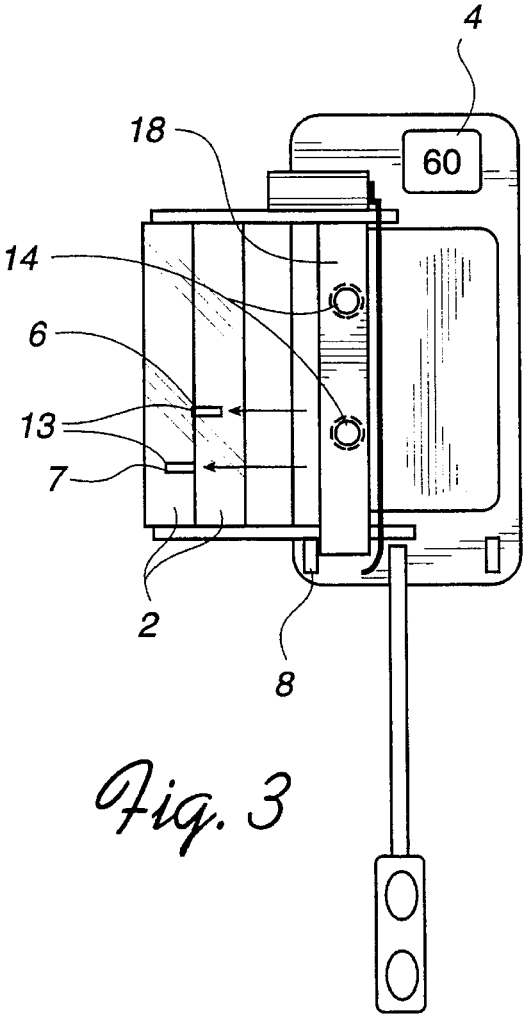
FIG. 3 is a front view of the range finder and sight targeting device which is used to compare to FIG. 2 to reveal marker positions for 60 yards in FIG. 3 vs 20 yards in FIG. 2.
Figure 4:
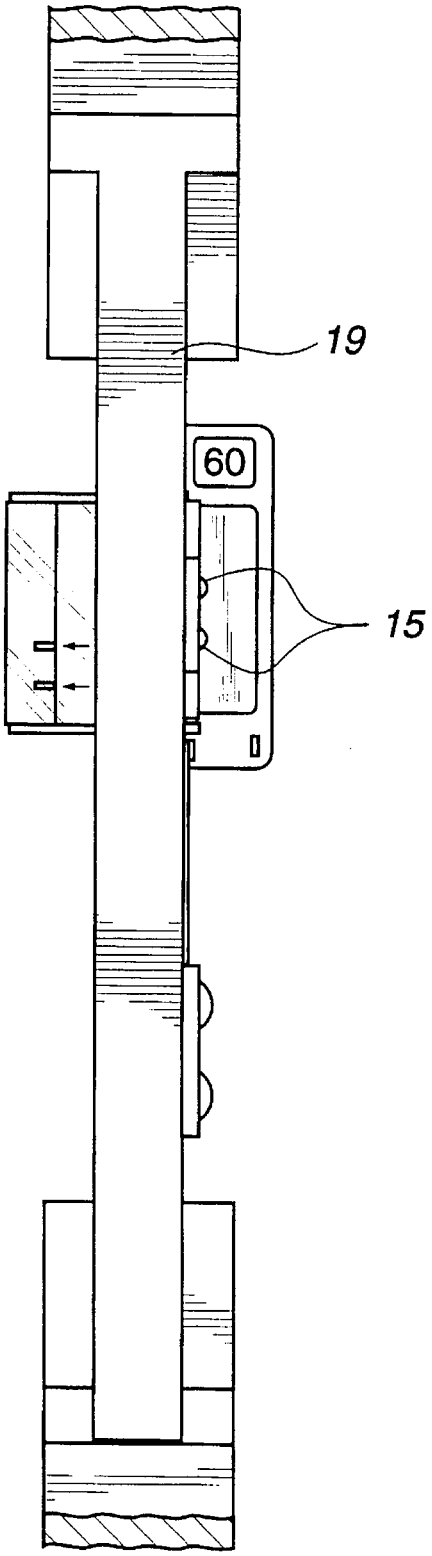
FIG. 4 is a front view of the range finder and sight targeting device mounted on a bow.
Figure 5:
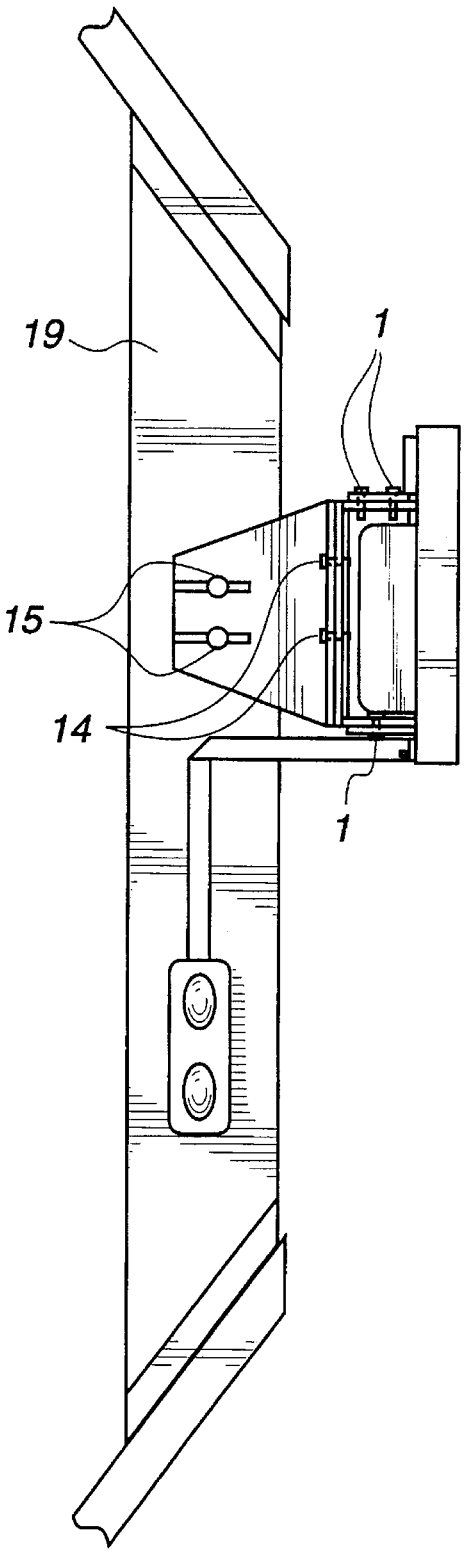
FIG. 5 is a side view of the range finder and sight targeting device mounted on a bow.
Figure 6B:
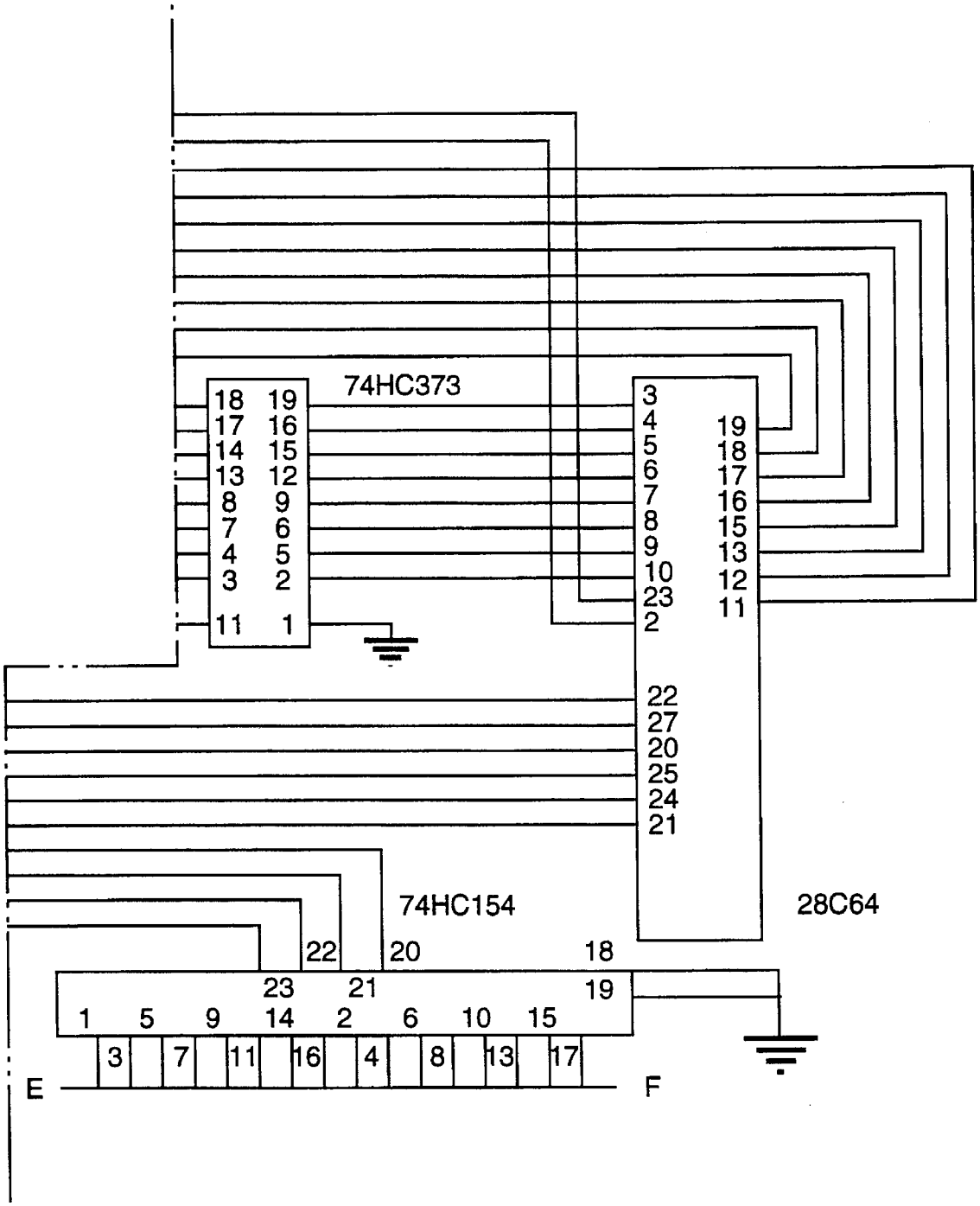

FIG. 3 shows digital numeric display 4 set at 60 yards and sight targeting marker 6 and range finder marker 7 at a closer distance 13 than FIG. 2 distance 13 which is set at numeric display 4 for 20 yards. This is due to similar targets at further distance appearing smaller than closer targets. FIG. 3 shows sight targeting marker 6 and range finder marker 7 in a lower position than FIG. 2 because when the target is bracketed with sight targeting marker 6 and range finder marker 7 at further distance, the sight targeting marker 6 needs to be lower in order for the archer to raise his bow to align the sight targeting marker 6 to the target for accurate arrow to target impact.

Functional description of how to program the range finder and sight targeting device. Refer to FIG.2

To program the bow sight and range finder device, power switch 9 is to be turned on. The archer will then turn on the program switch 8 then push the up button 10 or down button 11 to locate the numeric display 4 that represents the distance in yards the archer will be shooting from. The archer will then push the up button 10 and down button 11 together, this will set the numeric display and allow the archer to now locate the proper sight targeting marker to be used with the already set numeric display. The archer will now visually place windage line 20 on the middle of the target. Sight targeting marker 6 will show up on either side of windage line 20. The up button 10 or down button 11 can now be pushed to locate the proper sight targeting marker 6 for alignment to target for impact point of arrow. The archer will take several arrow shots to determine if the proper sight targeting marker is lit for proper alignment from arrow to target. The above process will be repeated until the proper sight targeting marker 6 has been identified. The archer will now push the up button 10 and down button 11 together in order to set the sight targeting marker and now locate the proper range finder marker 7. Range finder marker 7 will show up on either side of windage line 20. Sight targeting distance markers and range finder markers are generated from lights under cover 12 and FIG.1 reflected off of transparent window 2 as a reflected light source 3 back to the archer. All further reference to sight targeting markers and range finding markers will be known as reflective light off of transparent window 2

The archer will now position the sight targeting marker on top of the target and then push either the up button 10 or down button 11 to locate proper range finder marker 7 to be placed at the bottom of the target. Sight targeting marker 6 and range finding marker 7 will now bracket the archers target. The archer will now push the up button 10 and down button 11 to complete this particular program setting. The archer can now start the process over again to program another setting off the numeric display and sight targeting marker and range finder marker by pushing the up button 10 or down button the which will decrement or increment numeric display 4 to start the next sequence. After the archer is done programming the range finder and sight targeting device, program switch 8 is turned off to leave program mode and go to run mode.

Functional description to use the range finder and sight targeting device after it is programmed.

For targets at known distances the archer can use run mode by turning switch 8 off, then the archer can retrieve the proper numeric display 4 by using control buttons 10 and 11. The proper numeric display will represent the known shooting distance by the archer. Sight targeting marker 6 and range finder marker 7 will automatically be in position that was previously programmed by the archer.

For targets at unknown distances from the archer, the archer can retrieve the proper sight targeting marker 6 to be placed on top of the target and will be used with range finder marker 7 which will be placed on the bottom of the target and when the proper markers are retrieved the sight targeting marker 6 and range finder marker 7 will bracket the target and the sight targeting marker 6 will be in position to be used as a sight targeting marker for alignment of arrow to target. Numeric display 4 will also display the distance of the target which was previously programmed by the archer.

Functional description of the circuitry shown in FIGS. 6A and 6B and FIGS. 7A and 7B will now be given.

Power pins VCC and GND will not be shown on these chips due to common knowledge of location and function. Other pins using VCC or GND will be referenced.

The 87c51 has ROM which will contain a program that controls how the chip monitors and controls external connections. See attached code listing for the 87c51 chip. The 87c51 pins 32–39 are used for passing address locations to the 74hc373 chip and as the address is present, pin 30 of the 87c51 is set to latch the 74hc373 which will hold the address on pins 2,5,6,9,12,15,16,19 which are connected to the memory chip 24c64. While the address is being held, data to be stored in the address location is passed from chip 87c51 to chip 24c64 on pins 11–13,15–19. Chip 87c51 pin 16 is then used to enable the write of data into the address of chip 24c64. The 87c51 chip in the application shown is using 5 additional address lines to the 24c64 through pins 7,8,13, 27,28.

Chip 87c51 pins 1–4 are used to pass binary numbers to chip 74hc4511 which converts to 7 segment control through pins 9–15 to the numeric display. Chip 74hc4511 pin 5 strapped to ground and pin 3 strapped to VCC allows input pins 1,2,6,7 to control outputs 9–15 and allows pin 4 to set output pins to low level voltage when in is provided with a low level voltage. Chip 87c51 pins 5,6 are used to send control to the numeric display for displaying "ones" vs 'tens' LED segments. This control on pins 5,6 are sent through an inverter chip 74hc240 for proper polarity. Chip 74hc240 pin 19 strapped to ground, allows input pins 11,13,15,17 to be inverted to output pins 9,7,5,3. Chip 74hc240 pin 11 is strapped to ground to prevent a floating pin condition.

Chip 74hc373 pin 1 is strapped to ground to allow output from this chip.

Chip 87c51 pin 17 is used to retrieve data stored in chip 24c64. Chip 87c51 pins 32–39 are used to pass an address location through chip 74hc373 to chip 24c64, and then chip 87c51 pin 30 sets the chip 74hc373 latch then 87c51 pin 17 enables the output mode of chip 24c64 which data is provided from chip 28c64 pins 11–19 to chip 87c51.

Chip 87c51 pin 14 is used to control the chip enable line for chip 24c64. Chip 24c64 must be enabled before it can be used.

Chip 87c51 pins 18,19 are used for external clock control. A 3.5 MHz crystal and 2 30pf capacitors are used in this clocking circuitry.

Chip 87c51 pins 10,11,12 are used for monitoring external controls which the archer will use. See FIG.10.

Figure 10:
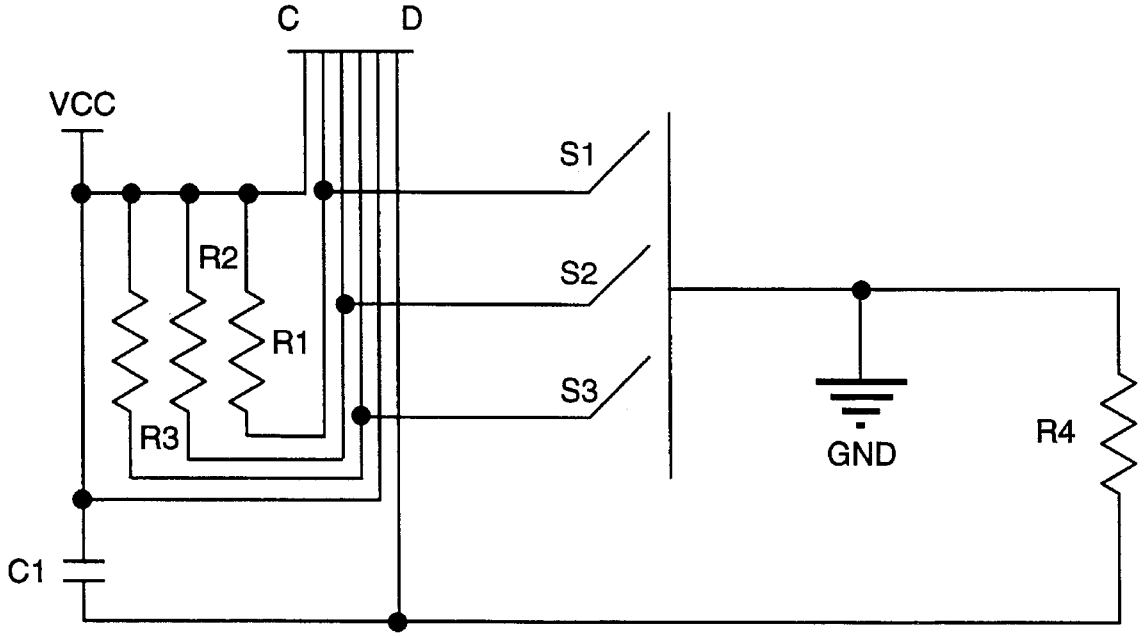
FIG. 10 is the control means circuitry.

Chip 87c51 pins 29,31, are strapped to VCC in FIG.10 because external ROM will not be used and these pins are used for external ROM purposes. Chip 87c51 pin 9 is used to reset the chip slightly after power up of the circuitry. This is done through a 10uf capacitor to VCC in FIG.10.

Figure 7:
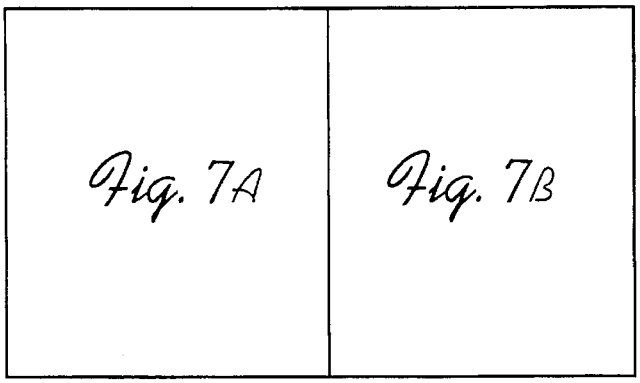
FIGS. 7A and 7B show the circuitry design of the light emitting diodes (LED's) which am controlled by the sight targeting and range finding circuitry for displaying the sight targeting and range finding LED markers and FIG. 7 shows how
Figure 7A:
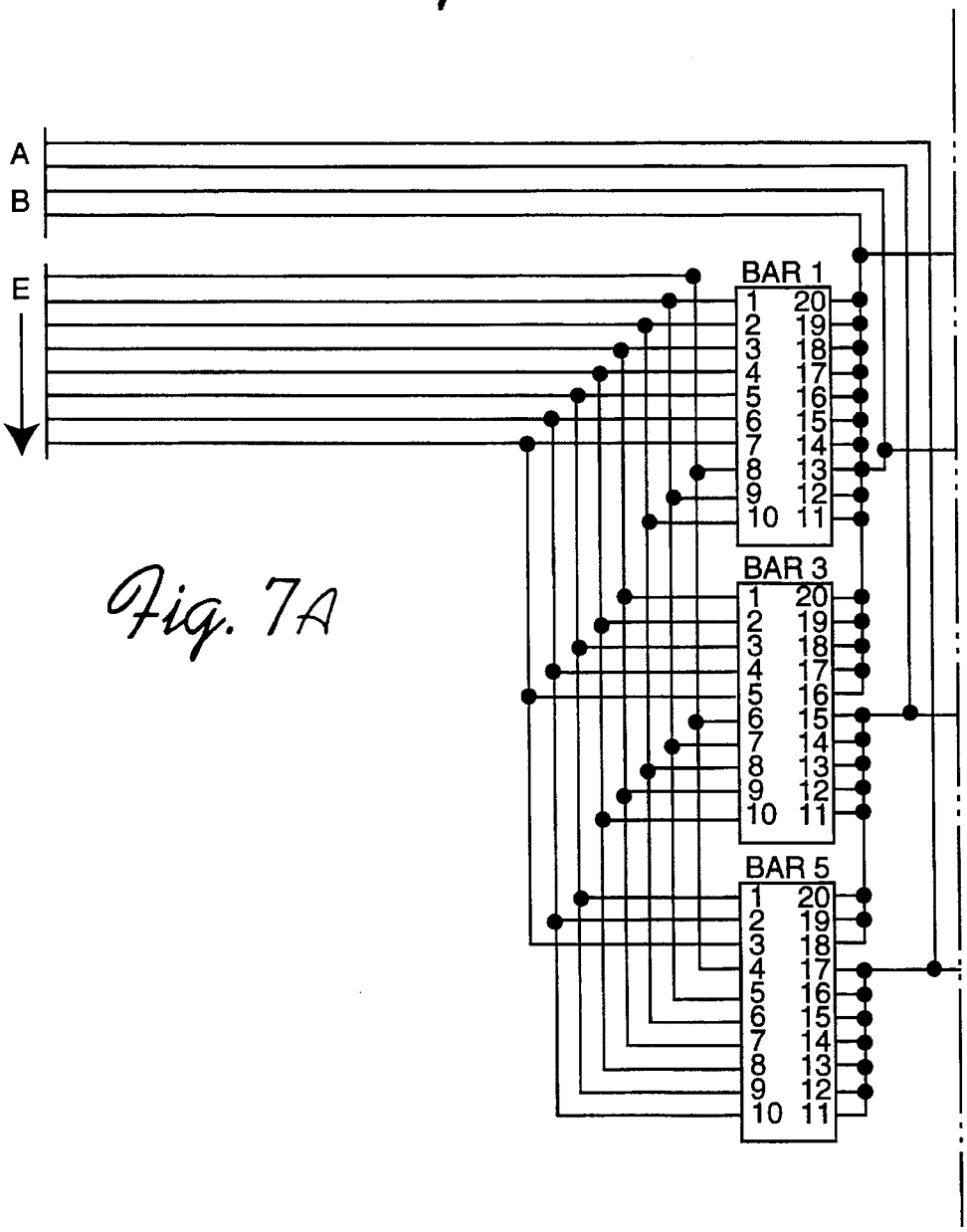

Chip 87c51 pin 15 is used to turn off and on the numeric display and sight targeting and range finding LED markers. The "off" condition is considered standby mode to save battery life. The "off" function is done by putting a low voltage level to chip 74hc4511 pin 4 which causes pins 9–15 to go too a low voltage level. Thus the numeric display LED segments are turned off. The "off" function also applies a low voltage level to chip 74hc240 pin 17 which inverts the signal to a high voltage level on pin 3 which connects to chip 74hc139 pin 1, then pins 4–7 go to a high level no matter what control pins 2,3 are doing. In turn the input of chip 74hc240 pins 2,4,6,8 with a high level will cause output pins 12,14,16,18 to invert from high voltage level to a low level voltage. These low level voltages will ensure that FIG.7A A–B input lines will thus be at a low level voltage. The A–B lines in FIG.7A are used to control which section of light emitting diode (LED) bar graphs are to be used. This control requires a high level voltage thus if low level, then all LED's will be turned off. These LED's are the sight targeting and range finding markers.

Chip 87c51 pins 25,26 are used in conjunction with pins 21–24. Pins 25,26 are binary numbers which are decoded by chip 74hc139 and the output will be 4 control lines pins 4–7, which chip 74hc240 inverts the control lines and provides the output on pins 12,14,16,18. The control of output pins 12,14,16,18 are allowed due to pin 1 being strapped to low level ground. Which ever output pin 12,14,16,18 is at a high level voltage will enable that group of LED's in FIG.7A to be used later. The binary number on pins 21–24 are decoded by chip 74hc154 and output on pins 1–11,13–17 which are all normally high level outputs and when brought low will activate individual LED's in FIG.7A and 7B through E–F as long as the control line through FIG.7A A–B is at a high level voltage. Chip 74hc154 pins 18,19 are strapped to ground to allow input pins 20–23 to control output pins 1–11,13–17.

Figure 8:
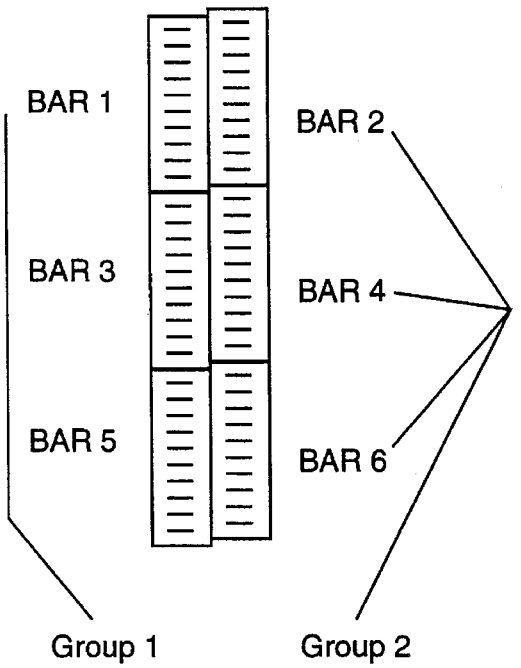
FIG. 8 is a picture of how the LED bar graph group 1 is placed offset to the adjacent bar graph group 2 for closer tolerance of sight targeting and range finding markers.

Functional description of FIG.8 will now be given.

Figure 7B:
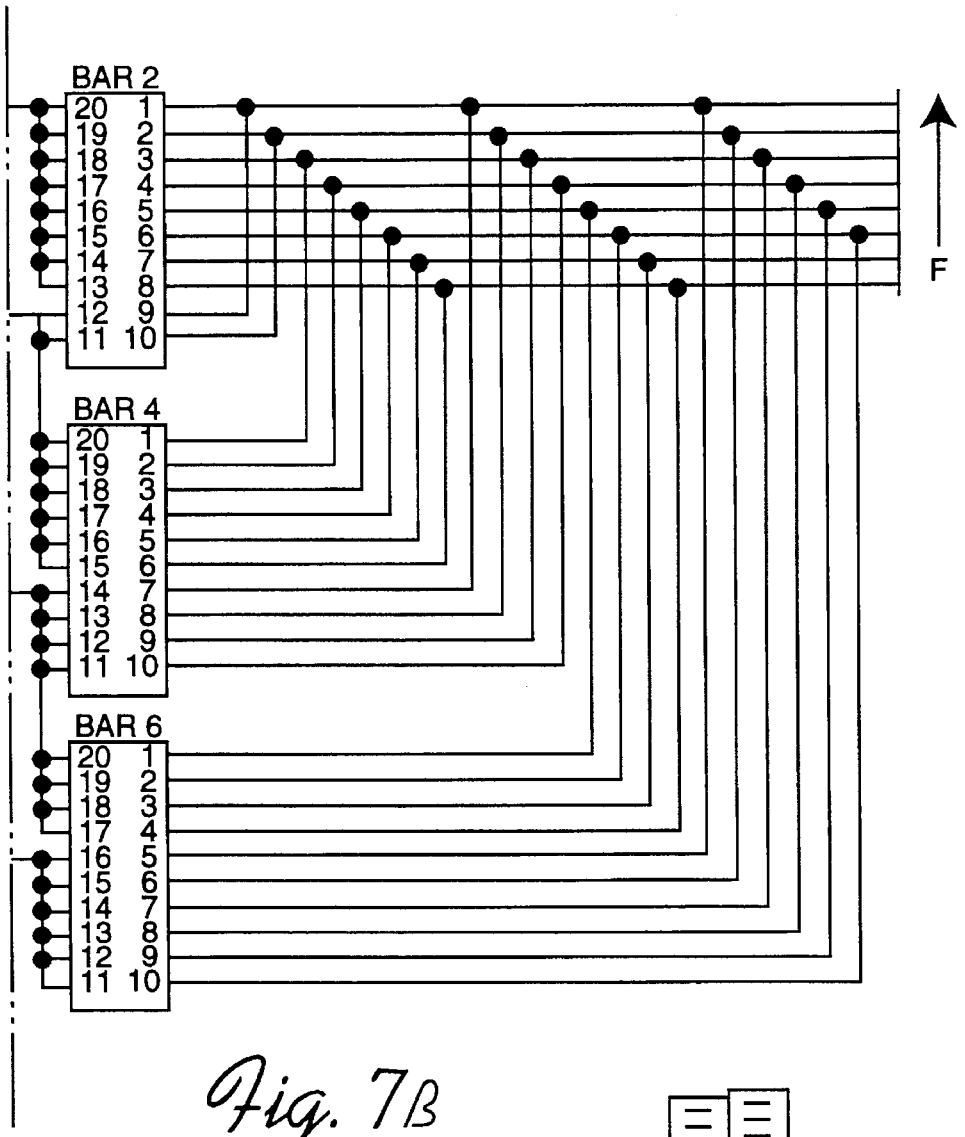

This is a drawing to show how FIGS. 7A and 7B LED bar graphs are positioned. Group 1 BAR1,BAR2,BAR3 are shown offset to Group 2 BAR2,BAR4,BAR6. This allows for closer tolerance of sight targeting and range finding markers. As an Example, the first LED on BAR2 is 0.05 inches above the first LED on BAR1 which the first LED on BAR1 is 0.05 inches above the second LED on BAR2, and so on . . .

Figure 9:
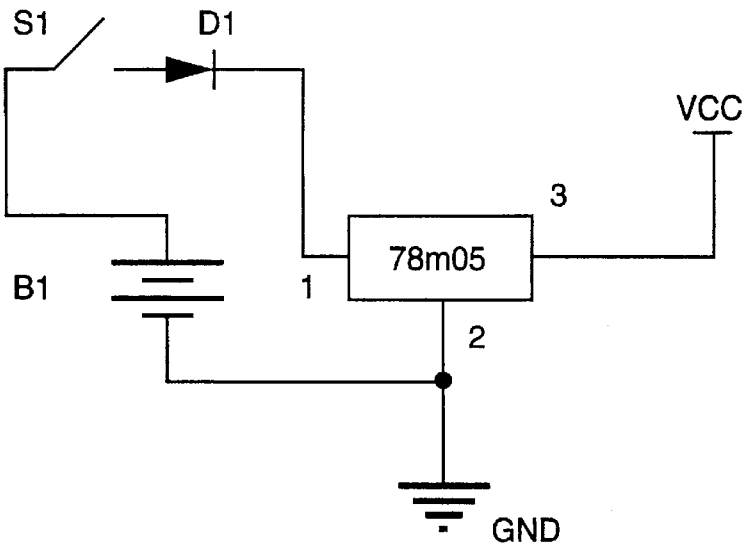
FIG. 9 is the power supply circuitry.

Functional description of FIG. 9 circuitry will now be given

B1 is a battery which is connected to ground on one side and to S1 on the other. S1 is used to turn on the power to the sight targeting and range finding device. DI is a diode to protect chip 78m05 from improper polarity connection of B1.78m05 is a 9 volt regulator which converts the 9 volt input on pin 1 to 5 volts output on pin 3 in reference to GND on pin 2. VCC and GND will supply power to all circuitry identified with VCC and GND.

Functional description of FIG. 10 circuitry will now be given

This is the control circuitry for the archer to interface to the sight targeting and range finding device. The first control is referred to as S2 the up control, the second is referred to as S3 the down control, the third S1 is used to control the 87c51 in FIG. 6A for either program mode for writing data to the 24c64 chip or mn mode for retrieving data from the 24c64 chip. These 3 control pins have pull up resistors R1,R2,R3 10K OHMS each to ensure proper high level voltage when either S1 or S2 or S3 are not connected to GND. GND is a low level voltage, and when either S1,S2,S3 are closed, the low level voltage will be sent to FIG. 6 to chip 87c51 which will recognize the low level voltage as the switch control being activated. R4 is an 8.2k ohm pull down resistor used in an RC circuit for the power on reset for the 87c51 chip.

80c51 PROGRAM CODE BELOW

```
;   MEMORY       80H     0       ADDRESS/DATA
;   DISPLAY      90H     1       NORMAL I/O
;   LED SCALE    A0H     2       1ST BYTE ADDRESS PAGING, 2ND I/O CONTROL
;   BUTTONS/LED  B0H     3       P3.0 - P3.5 = I/O, P3.6 & P3.7 - READ WRIGHT
;
P3_0             BIT     0B0H.0   ; DOWN
P3_1             BIT     0B0H.1   ; UP
P3_2             BIT     0B0H.2   ; PROG
P3_3             BIT     0B0H.3   ; address 11 (not used)
                                  ; address 12 (not used, grounded on mem chip)
P3_4             BIT     0B0H.4   ; standby memory control (CE)
P3_5             BIT     0B0H.5   ; IDLE
P3_6             BIT     0B0H.6   ; PROM_WRITE
P3_7             BIT     0B0H.7   ; PROM_READ
                 ;
P2_6             BIT     0A0H.6       ; ADDRESS 9 FOR EPROM PAGING
P2_7             BIT     0A0H.7       ; ADDRESS 10

D_VAR            EQU     30H          ; DEFINE DIRECT BYTE LOCATIONS
Y_VAR            EQU     31H
H_VAR            EQU     32H
ADD_Y            EQU     33H
ADD_H            EQU     34H
ADD_Y_TEMP       EQU     35H
ADD_H_TEMP       EQU     36H
TEMP_H           EQU     37H
GET_H            EQU     38H
GET_D            EQU     39H
GET_Y            EQU     3AH
DISP_LOOP        EQU     3BH
TIMER_LOOP       EQU     3CH
PREV_TIME        EQU     3DH
Y_COUNT          EQU     3EH
H_COUNT          EQU     3FH
IDLE_STATUS      EQU     40H
DISP_LOOP_2      EQU     41H
DISP_LOOP_3      EQU     42H
DELAY_LOOP       EQU     43H
DELAY_LP_AGAIN   EQU     44H
GET_A_H          EQU     45H
Y_COUNT_1ST      EQU     46H
H_COUNT_1ST      EQU     47H
ONES             EQU     48H
TENS             EQU     49H
STORE_NEW_ADD_Y  EQU     50H
STORE_NEW_DVAR   EQU     51H
OLD_DVAR         EQU     52H
CLEARING_OLD     EQU     53H
DELAY_LOOP_2     EQU     54H
DELAY_LP_AGN_2   EQU     55H
BTN_LP_2         EQU     56H

BIT_SPACE_1      EQU     20H

DOWN             BIT     BIT_SPACE_1.0        ;DEFINE BIT LOCATIONS
UP               BIT     BIT_SPACE_1.1
PROG             BIT     BIT_SPACE_1.2
RUN_D            BIT     BIT_SPACE_1.3 ; CONTROL BITS TO IDENTIFY CURRENT STATUS
RUN_Y            BIT     BIT_SPACE_1.4 ; OF ACTIVE PROGRAM
RUN_H            BIT     BIT_SPACE_1.5
RAN_ONCE         BIT     BIT_SPACE_1.6
NEW_PROG         BIT     BIT_SPACE_1.7 ; BIT TO CONTROL EPROM LOCATION CLEAR

STOP_D_UP        EQU     99H          ;HEX
STOP_Y_UP        EQU     3CH          ;HEX
STOP_H_UP        EQU     3CH          ;HEX
STOP_D_DOWN      EQU     00H          ;HEX
STOP_Y_DOWN      EQU     00H          ;HEX
STOP_H_DOWN      EQU     00H          ;HEX
MAX_YARDAGE      EQU     9AH          ;HEX
NO_PROGRAM       EQU     0FFH          ;HEX
T_LOOP_MAX       EQU     0FFH
```

```
D_LOOP_MAX      EQU     0FFH

INIT:           MOV     A,#00H
                MOV     D_VAR,A
                MOV     Y_VAR,D_VAR
                MOV     H_VAR,Y_VAR
                MOV     ADD_Y,H_VAR
                MOV     TEMP_H,ADD_Y
                MOV     CLEARING_OLD,TEMP_H
                MOV     ADD_H,#40H
                MOV     ADD_Y_TEMP,#00H
                MOV     ADD_H_TEMP,#40H
                MOV     IDLE_STATUS,#01H      ; SET LED & DISPLAY STATUS AS 'ON'
                MOV     0B0H,A
                SETB    P3_0              ; ALLOW DOWN INPUT
                SETB    P3_1              ;   "   UP     "
                SETB    P3_2              ;   "   PROG   "
                SETB    P3_5              ; ALLOW DISPLAY & LED'S TO TURN ON
                SETB    P3_6              ; EPROM WRITE
                SETB    P3_7              ; EPROM READ
                ;
                MOV     DISP_LOOP,A       ; CLEAR LOOP VARIABLES
                MOV     DISP_LOOP_2,#02H ; " " " "
                MOV     DISP_LOOP_3,#05H ; USE 1ST TIME BUTTON PUSHED
                MOV     TIMER_LOOP,A      ; " " " "
                MOV     BTN_LP_2,#00H
                MOV     DELAY_LOOP_2,#0BFH
                MOV     DELAY_LP_AGN_2,#03H
                MOV     DELAY_LOOP,#03AH
                MOV     PREV_TIME,#03H    ; CLEAR TIMER/BUTTON STATUS CONTROL
                MOV     DELAY_LP_AGAIN,#03H
                MOV     Y_COUNT,#06H    ; LED_Y ON DURATION BEFORE LED_H UPDATE
                MOV     H_COUNT,#00H    ; SEE PROGRAM FOR H_COUNT DURATION
                MOV     Y_COUNT_1ST,#0FFH
                MOV     H_COUNT_1ST,#00H
                MOV     ONES,#0FFH
                MOV     TENS,#0FFH

                CLR     NEW_PROG
                CLR     RUN_D
                CLR     RUN_H
                CLR     RUN_Y

                CLR     P3_3    ; ADDRESS 11 (NOT USED)
                SETB    P3_4    ; MEMORY ENABLE (ce)
                ;

MAIN_PROG:      SETB    P3_4     ; Ensure memory is off
                MOV     0A0H,#00H        ;Ensure page 0

                MOV     Y_VAR,ADD_Y             ; @ADD_Y

                MOV     H_VAR,TEMP_H            ; @TEMP_H

                MOV     R0,H_VAR
                CJNE    R0,#0FFH,DATA_VALID  ; if power or program turned
                MOV     H_VAR,#00H              ;off prior to programing H_var
                                                ;then FF may exist, change to
                                                ;00h

DATA_VALID:     CLR     UP
                CLR     DOWN
                CLR     PROG

BUTTON_CNTRL:   INC     DISP_LOOP               ; delay DISPLAY UPDATE
                MOV     A,0B0H                  ; MOV PORT 3 STATUS TO ACC
                ANL     A,#03H                  ; MASK UP & DN BUTTON ONLY
                CJNE    A,PREV_TIME,TIMER       ; BUTTON CHANGE, GO TO TIMER

                MOV     R3,A     ; STORE BUTTON STATUS

;display update
                MOV     A,ONES
                JZ      SKIP_ONES
                DJNZ    ONES,DO_ONES
```

```
SKIP_ONES:      DJNZ    TENS,DO_TENS
                MOV     ONES,#0FFH
                MOV     TENS,#0FFH
                AJMP    DO_ONES

DO_TENS:        MOV     A,D_VAR
                SWAP    A
                ANL     A,#0FH
                ADD     A,#20H          ; #2F AFTER INVERT AT OUTSIDE CHIP
                AJMP    DISPLAY

DO_ONES:        MOV     A,D_VAR
                ANL     A,#0FH
                ADD     A,#10H          ; #1F AFTER INVERT AT OUTSIDE CHIP

DISPLAY:        MOV     090H,A

                MOV     A,R3        ; GET BUTTON STATUS

                MOV     R1,DISP_LOOP            ; MOV CONTENTS OF DISP_LOOP TO R1

                ;
                MOV     R0,Y_COUNT
                CJNE    R0,#00H,DO_Y        ; IF Y_LED STILL OCCURING DO_Y

                MOV     0A0H,H_VAR              ; ELSE UPDATE LED_H TO PORT 2

                INC     H_COUNT_1ST         ; WHEN H_COUNT REACHS #FFH GET
                MOV     R2,H_COUNT_1ST
                CJNE    R2,#0FFH,NEXT
                INC     H_COUNT
                MOV     H_COUNT_1ST,#00H

                MOV     R0,H_COUNT
                CJNE    R0,#02H,NEXT      ; ready for y_var update again
                MOV     Y_COUNT,#06H            ; RESET TO START Y_VAR UPDATE
                MOV     Y_COUNT_1ST,#0FFH
                MOV     H_COUNT_1ST,#00H
                MOV     H_COUNT,#00H            ; "    "    "

DO_Y:           MOV     0A0H,Y_VAR              ; UPDATE LED_Y TO PORT 2
                DJNZ    Y_COUNT_1ST,NEXT
                DEC     Y_COUNT                   ; WHEN Y_COUNT = 0, DO INC H
                MOV     Y_COUNT_1ST,#0FFH
                ;
NEXT:           CJNE    R1,#D_LOOP_MAX,BUTTON_CNTRL ; MAY LEAVE BEFORE Y_VAR
                MOV     DISP_LOOP,#00H
                DJNZ    DISP_LOOP_2,BUTTON_CNTRL
                MOV     DISP_LOOP_2,#02H        ; DISPLAY UPDATE FREQUENCY

                JB      RAN_ONCE,DID_ONCE         ; IF RAN ONCE, IGNORE NEXT LOOP
                DJNZ    DISP_LOOP_3,BUTTON_CNTRL
                MOV     DISP_LOOP_3,#05H

DID_ONCE:       MOV     0A0H,Y_VAR              ; ENSURE Y_VAR UPDATE IS LAST
                CJNE    A,#00H,OK_NOT_BOTH        ; GO AHEAD, BOTH NOT PUSHED
LINK_RLSE:      AJMP    BUTTON_CNTRL              ; BOTH PUSHED, NOW CHECK RELEASE

TIMER:          INC     TIMER_LOOP                ; BUTTON BOUNCE CONTROL
                MOV     DISP_LOOP,#00H            ; NEW BTN, RESET DISP_LOOP TIME
                MOV     DISP_LOOP_2,#05H
                MOV     DISP_LOOP_3,#05H

                MOV     R0,TIMER_LOOP           ; MOV CONTENTS OF TIMER_LOOP TO R0
                CJNE    R0,#T_LOOP_MAX,TIMER
                MOV     TIMER_LOOP,#00H
                INC     BTN_LP_2            ; SECOND LOOP TO SLOW DOWN SINGLE
                MOV     R0,BTN_LP_2         ; PUSH OF BUTTON SELECTION
                CJNE    R0,#05H,TIMER
                MOV     BTN_LP_2,#00H

                MOV     R0,PREV_TIME              ; CHECK PREV TIME THRU
                CJNE    R0,#00H,CHECK_OTHER       ; IF #00 BOTH PUSHED, FALL THRU
                CJNE    A,#03H,LINK_RLSE          ; BOTH BUTTONS NOT RELEASED
                AJMP    BOTH_RELEASED
```

```
CHECK_OTHER:    JB      RAN_ONCE,SKIP     ; IF RAN ONCE ALREADY,DON'T DO UP OR DN
                CJNE    A,#03H,SKIP       ; UP OR DN PUSHED AND RELEASED IF #03H
                MOV     R0,PREV_TIME
                CJNE    R0,#03H,DO_ONCE ; IF PREV_TIME = UP/DN THEN DO
                AJMP    SKIP              ; ELSE SKIP

DO_ONCE:        CJNE    R0,#01H,DO_UP ; IF NOT DOWN THEN DO UP
                SETB    DOWN                    ; ELSE DO DOWN
                AJMP    GET_PROG                ; GO CHECK PROGRAM SWITCH

SKIP:           MOV     PREV_TIME,A               ; EITHER 0 OR 1 BUTTON PUSHED
                AJMP    BUTTON_CNTRL              ; NOW GO BACK TO CONFIRM

BOTH_RELEASED:  MOV     PREV_TIME,A     ; NOW SET VAR TO CURRENT BUTTON STATUS
                SETB    UP              ; NOW THAT BOTH RELEASED, SET UP & DN
                SETB    DOWN            ; IN ORDER TO DO REST OF PROGRAM
                MOV     C,P3_2          ; GET PROGRAM SWITCH STATUS
                MOV     PROG,C          ; " " " "
                AJMP    CHECK_RUN

OK_NOT_BOTH:    CJNE    A,#03H,OK
                CLR     RAN_ONCE
                AJMP    MAIN_PROG

OK:             CJNE    A,#01H,DO_UP          ; NO DN BUTTON PUSHED
                SETB    DOWN
                AJMP    GET_PROG

DO_UP:          SETB    UP

GET_PROG:       MOV     C,P3_2          ; GET PROGRAM SWITCH STATUS
                MOV     PROG,C          ; PROG SWITCH
                SETB    RAN_ONCE
;!!!!!!!!!!!!!!

CHECK_RUN:      JNB     PROG,PROG_OK
                CLR     RUN_H
                CLR     RUN_Y
                CLR     RUN_D

CHECK_UP:       JNB     UP,CHECK_DOWN           ; NO UP PUSHED, CHECK DOWN
                JB      DOWN,IDLE               ; UP & DN PUSHED, GO TO IDLE
                MOV     R0,ADD_Y_TEMP
                CJNE    R0,#STOP_Y_UP,UP_GO     ; IF LED IS NOT 61 THEN CONT.
                AJMP    NOT_FOUND               ; NOT FOUND, NO PROGRAM

UP_GO:          INC     ADD_Y_TEMP
                INC     ADD_H_TEMP
                AJMP    GET_MEMORY

IDLE:           MOV     A,IDLE_STATUS
                SWAP    A
                CJNE    A,#01H,OFF                ; IF NOT ON JUMP TO OFF
                SETB    P3_5                      ; TURN ON
                MOV     IDLE_STATUS,#01H          ; SET ON STATUS
                AJMP    MAIN_PROG
OFF:            CLR     P3_5                      ; TURN OFF LED'S & DISPLAY
                MOV     IDLE_STATUS,#10H          ; SET OFF STATUS
                AJMP    MAIN_PROG

                                          ;??? POSSIBLE SCORE KEEPING
CHECK_DOWN:     JNB     DOWN,RETURN_1     ; 2ND PUSH OF UP & DN TOGETHER
                MOV     R0,ADD_Y_TEMP           ; @ADD_Y
                CJNE    R0,#STOP_Y_DOWN,DOWN_GO
                AJMP    NOT_FOUND

DOWN_GO:        DEC     ADD_Y_TEMP
                DEC     ADD_H_TEMP

GET_MEMORY:     CLR     P3_4            ; MEM ON
                MOV     R0,ADD_H_TEMP
                MOVX    A,@R0                ; GET HIEGHT LED DISP.
                MOV     GET_H,A
                MOV     R0,ADD_Y_TEMP
```

```
                MOVX    A,@R0               ; GET DISP DATA
                MOV     GET_D,A
                MOV     R0,GET_D
                CJNE    R0,#NO_PROGRAM,RETURN_2   ;  found program, now leave
                AJMP    CHECK_UP                  ; CONTINUE TO SEARCH EPROM

NOT_FOUND:      MOV     ADD_Y_TEMP,ADD_Y
                MOV     ADD_H_TEMP,ADD_H
                SETB    P3_4                      ; MEM OFF

RETURN_1:       AJMP    MAIN_PROG

; !!!!!!!

PROG_OK:        SETB    P3_5                ; MAKE SURE IDLE IS OFF
                MOV     DELAY_LOOP,#0BFH     ; IF SWITCH PROG TO RUN, RESET
                MOV     DELAY_LP_AGAIN,#03H ; IF SWITCHC PROG TO RUN, RESET
                MOV     IDLE_STATUS,#01H ; NOW STORE IDLE STATUS
                JNB     UP,CHECK_DN         ; IF NO UP PUSHED, CHECK DOWN
                JB      RUN_H,UP_LED_H      ; PROG. UP_LED_H STILL OCCURING
                JB      RUN_Y,UP_LED_Y      ; PROG. UP_LED_Y STILL OCCURING
                JB      RUN_D,UP_DISP       ; PROG. UP_DISP STILL OCCURING
                JB      DOWN,LINK_JUMP      ; CLR EPROM 1ST TIME UP & DN PUSHED
                SETB    RUN_D
                AJMP    UP_DISP

CHECK_DN:       JNB     DOWN,RETURN_3
                JB      RUN_H,DN_LED_H          ; JMP IF LED_H STILL OCCURING
                JB      RUN_Y,DN_LED_Y          ; JMP IF LED_Y STILL OCCURING
                SETB    RUN_D
                AJMP    DN_DISP

RETURN_2:       SETB    P3_4                ; MEM OFF
                MOV     TEMP_H,GET_H        ; FOUND DATA NOW XFER TO TEMP_H
                MOV     D_VAR,GET_D         ; FOUND DATA NOW XFER TO D_VAR
                MOV     ADD_Y,ADD_Y_TEMP
                MOV     ADD_H,ADD_H_TEMP
RETURN_3:       AJMP    MAIN_PROG

;!!!!!!!!!!  CHECK UP LIMIT

UP_DISP:        JBC     DOWN,DO_LED_Y  ; DONE WITH DSP, NOW CLEAR DN & GO TO YD
                MOV     R0,D_VAR
                CJNE    R0,#STOP_D_UP,UP_DISP_OK  ; STOP UP IF THRESHOLD MET
                AJMP    MAIN_PROG

DO_LED_Y:       SETB    RUN_Y
                MOV     R0,GET_Y
                CJNE    R0,#0FFH,GO_CLR         ; ONLY CLR IF VALUE FOUND
                AJMP    MAIN_PROG                  ; ELSE DO NOT CLR
GO_CLR:         SETB    NEW_PROG
                ACALL   CLR_EPROM
                AJMP    MAIN_PROG

UP_LED_Y:       JB      DOWN,LINK_Y_PROG
                MOV     R0,ADD_Y
                CJNE    R0,#STOP_Y_UP,UP_Y_OK
                AJMP    MAIN_PROG

UP_LED_H:       JB      DOWN,LINK_H_PROG
                MOV     R0,TEMP_H
                CJNE    R0,#STOP_h_UP,UP_H_OK
                AJMP    MAIN_PROG

; !!!!!!!!!   OK, LIMIT NOT MET YET

UP_DISP_OK:     MOV     A,D_VAR
                ADD     A,#01H
                DA      A
                MOV     D_VAR,A
                ACALL   GET_PROM_STS
                AJMP    MAIN_PROG

UP_Y_OK:        INC     ADD_Y
                INC     ADD_H
```

```
                AJMP    MAIN_PROG

UP_H_OK:        INC     TEMP_H
                AJMP    MAIN_PROG

;  !!!!!!!!!!!!!!!!!!!!!!!!!!!!!!

LINK_JUMP:      AJMP    CLR_EPROM

LINK_Y_PROG:    AJMP    P_Y_EPROM
LINK_H_PROG:    AJMP    P_H_EPROM

;  !!!!!!!!!!!!!!!!!!!!!!!!!!!!!!

; !!!!!!!!!!  CHECK DOWN LIMIT

DN_DISP:        MOV     R0,D_VAR
                CJNE    R0,#STOP_D_DOWN,DN_D_OK
                AJMP    MAIN_PROG

DN_LED_Y:       MOV     R0,ADD_Y
                CJNE    R0,#STOP_Y_DOWN,DN_Y_OK
                AJMP    MAIN_PROG

DN_LED_H:       MOV     R0,TEMP_H
                CJNE    R0,#STOP_H_DOWN,DN_H_OK
                AJMP    MAIN_PROG

; !!!!!!!!!!  OK, LIMIT NOT MET YET

DN_D_OK:        MOV     A,D_VAR
                ADD     A,#99H
                DA      A
                MOV     D_VAR,A
                ACALL   GET_PROM_STS
                AJMP    MAIN_PROG

DN_Y_OK:        DEC     ADD_Y
                DEC     ADD_H
                AJMP    MAIN_PROG

DN_H_OK:        DEC     TEMP_H
                AJMP    MAIN_PROG
; !!!!!!!
GET_CLR_STS:    ACALL   GET_PROM_STS      ; USE WHEN CLEARING EPROM
                AJMP    CLR_EPROM

; !!!!!!!   GET EEPROM CURRENT STATUS DURING PROGRAM MODE

GET_PROM_STS:   CLR     P3_4              ; MEM ON

                ACALL   DELAY_LONG

                MOV     0A0H,#40H       ; PORT 2, ADDRESS PAGE 2 BIT

                ACALL   DELAY_LONG

                MOV     R0,D_VAR
                MOVX    A,@R0           ; GET ADD_Y FROM D_VAR PAGE 2
                MOV     GET_Y,A

                ACALL   DELAY_LONG

                ADD     A,#40H          ; ADD_H IS 64 ADDRESS'S HIGHER THAN ADD_Y
                MOV     GET_A_H,A         ; UPDATE ADD_H FOR FUTURE INC OR DEC

DELAY_G:        NOP
                DJNZ    DELAY_LOOP,DELAY_G
                MOV     DELAY_LOOP,#0BFH
                DJNZ    DELAY_LP_AGAIN,DELAY_G
                MOV     DELAY_LP_AGAIN,#03H

                MOV     0A0H,#80H    ; PORT2, ADDRESS PAGE 3 BIT

                ACALL   DELAY_LONG
```

```
            MOVX    A,@R0          ; GET TEMP_H DATA FROM D_VAR PAGE 3
            MOV     GET_H,A

            ACALL   DELAY_LONG

            MOV     0A0H,#00H

            MOV     R0,GET_Y
            CJNE    R0,#0FFH,FOUND  ; IF NOT #FF THEN FOUND DATA
            SETB    P3_4                        ;MEM OFF
            RET                           ; ELSE RETURN WITH NO CHANGE

FOUND:      MOV     ADD_Y,GET_Y
            MOV     TEMP_H,GET_H
            MOV     ADD_H,GET_A_H
            MOV     ADD_H_TEMP,ADD_H
            MOV     ADD_Y_TEMP,ADD_Y
            SETB    P3_4                        ;MEM OFF
            RET

; !!!!!!!!!  PROGRAM EEPROM

P_Y_EPROM:  CLR     P3_4                      ;MEM ON

            ACALL   DELAY

            MOV     STORE_NEW_ADD_Y,ADD_Y    ; CLEAR OLD ADDRESS'S
            MOV     STORE_NEW_DVAR,D_VAR     ;
            MOV     R0,ADD_Y                 ;
            MOVX    A,@R0                    ;
            MOV     OLD_DVAR,A               ;
            CJNE    A,#0FFH,CLR_OLD_DADD     ;

RETURN_4:   MOV     A,D_VAR                  ; SET NEW ADDRESS'S BACK
            MOV     R0,ADD_Y                 ;

            CJNE    R0,#00H,CLR_PG1_Y  ; ADD_Y = 0 THEN CLEAR OLD VALUES
            MOV     A,#0FFH   ; if yardage = 1st LED then clear mem spot

CLR_PG1_Y:  MOVX    @R0,A          ; MOV D_VAR INTO ADD_Y ADDRESS PAGE 1
                                   ; AND CLEAR OLD ADD_Y CONTENTS IF ANY
            ACALL   DELAY

            MOV     0A0H,#40H   ; SET PAGE 2 ADDRESS  P2.6
            AJMP    DELAY_2     ;JUMP AROUND CLEARING OLD DVAR ADD

CLR_OLD_DADD: MOV   0A0H,#40H   ; SET PAGE 2 BIT
            MOV     ADD_Y,#00H        ; SET TO 00 SO FALLTHROUGH CLEARS ALL
            MOV     D_VAR,OLD_DVAR    ; USE OLD D_VAR ADDRESS
            MOV     CLEARING_OLD,#01H ; FLAG THAT OLD IS BEING CLEARED

DELAY_2:    ACALL   DELAY

            MOV     R0,D_VAR
            MOV     A,ADD_Y
            CJNE    A,#00H,CLR_PG2_Y
            MOV     A,#0FFH          ; if add_y = 0 then clear mem spot

CLR_PG2_Y:  MOVX    @R0,A          ; MOVE ADD_Y INTO D_VAR ADDRESS

            ACALL   DELAY

            MOV     0A0H,#00H         ; turn page off

            ACALL   DELAY

            MOV     A,CLEARING_OLD
            CJNE    A,#00H,P_H_EPROM ;IF CLEARING OLD CONTINUE ON

            CLR     RUN_Y          ; YARDAGE DONE, NOW PROGRAM HEIGHT
            SETB    RUN_H  ; get ready to program hieght -PROG_OK switch
            MOV     A,ADD_Y
            CJNE    A,#00H,DONE_Y_P
            AJMP    P_H_EPROM    ; clear H_eprom mem locations
```

```
DONE_Y_P:       SETB    P3_4            ; MEM OFF
                AJMP    MAIN_PROG

P_H_EPROM:      CLR     P3_4            ; MEM ON

                ACALL   DELAY

                MOV     A,H_VAR
                MOV     R0,ADD_Y
                CJNE    R0,#00H,CLR_PG1_H
                MOV     A,#0FFH

CLR_PG1_H:      MOV     R0,ADD_H
                MOVX    @R0,A       ; MOV H_VAR INTO ADD_H, SEE GET PROM STS

                ACALL   DELAY

                MOV     0A0H,#80H  ; SET ADDRESS PAGE 3 FOR DISPLAY - HEIGHT

                ACALL   DELAY

                MOV     A,H_VAR
                MOV     R0,ADD_Y
                CJNE    R0,#00H,CLR_PG2_H
                MOV     A,#0FFH

CLR_PG2_H:      MOV     R0,D_VAR
                MOVX    @R0,A       ; MOVE H_VAR TO D_VAR ADDRESS

                ACALL   DELAY

                MOV     0A0H,#00H  ; P2.7

                ACALL   DELAY

                MOV     R0,CLEARING_OLD
                CJNE    R0,#00H,GOBACK  ; IFWAS CLEARING OLD, GO BACK FOR NEW

                CLR     RUN_H   ; HEIGHT DONE, NOW GO BACK TO DISPLAY-RUN_D
                SETB    P3_4    ; MEM OFF
                AJMP    MAIN_PROG

GOBACK:         MOV     D_VAR,STORE_NEW_DVAR
                MOV     ADD_Y,STORE_NEW_ADD_Y
                MOV     CLEARING_OLD,#00H ;RESET CLEARING OLD TO FALSE
                AJMP    RETURN_4   ; GOBACK TO START OF CLEARING OLD FOR NEW

;!!!!! !!!!!  !

CLR_EPROM:      ACALL   DELAY
                CLR     P3_4            ; MEM ON
                MOV     0A0H,#00H         ; SET PAGE 1 BIT
                SETB    RUN_D
                MOV     A,#0FFH
                MOV     R0,ADD_Y
;-------------------------

CLR_PAGE_Y:     MOVX    @R0,A           ; CLEAR PAGE Y
                ACALL   DELAY_LONG
;---------------------
                MOV     R0,ADD_H

                MOVX    @R0,A           ; CLEAR PAGE H
                ACALL   DELAY

;-------------------
                MOV     0A0H,#40H         ; SET PAGE 2 BIT

                ACALL   DELAY

                MOV     R0,D_VAR

                MOVX    @R0,A           ; CLEAR PAGE 2
                ACALL   DELAY
```

```
;-----------------------
                MOV     CA0H,#03H       ; SET PAGE 3 BIT

                ACALL   DELAY

                MOVX    @R0,A           ; CLEAR PAGE 3

                ACALL   DELAY

                JBC     NEW_PROG,CLR_ONCE ; ONE TIME CLR WHEN NEW Y_PROGRAM

                MOV     A,D_VAR
                CJNE    A,#0FFH,INCREASE_D
                MOV     A,ADD_Y
                CJNE    A,#03FH,INCREASE_Y
                AJMP    LEAVE

INCREASE_D:     ADD     A,#01H          ; CONTINUE TO CLEAR
                MOV     D_VAR,A
                AJMP    CLR_EPROM

INCREASE_Y:     ADD     A,#01H          ; CONTINUE TO CLEAR
                MOV     ADD_Y,A
                ADD     A,#40H          ; ADD_H IS 64 ADDRESS'S HIGHER THAN ADD_Y
                MOV     ADD_H,A         ; UPDATE ADD_H ALSO
                AJMP    CLR_EPROM

LEAVE:          SETB    P3_4            ; MEM OFF
                MOV     ADD_Y,#00H
                MOV     ADD_Y_TEMP,#00H
                MOV     ADD_H,#40H
                MOV     ADD_H_TEMP,#40H
                MOV     D_VAR,#00H
                MOV     TEMP_H,#0CH
                MOV     GET_H,#00H
                MOV     GET_Y,#00H
                AJMP    MAIN_PROG

CLR_ONCE:       RET

DELAY:          NOP
                DJNZ    DELAY_LOOP,DELAY
                MOV     DELAY_LOOP,#04AH
                DJNZ    DELAY_LP_AGAIN,DELAY
                MOV     DELAY_LP_AGAIN,#03H
                RET

DELAY_LONG:     NOP
                DJNZ    DELAY_LOOP_2,DELAY_LONG
                MOV     DELAY_LOOP_2,#0BFH
                DJNZ    DELAY_LP_AGN_2,DELAY_LONG
                MOV     DELAY_LP_AGN_2,#03H
                RET

                ;
                END
```

I claim:

1. Apparatus for a bow which comprises:

a user input device; a display; and a controller, which controller comprises a programmer and a runner; wherein:

the programmer comprises a program means, responsive to user input program commands received from the user input device, for: (a) selecting a distance and a display position for one of one or more markers and (b) storing information from which a representation of the distance and the display position can be retrieved; and the runner comprises a run means, responsive to user input run commands received from the user input device, for: (a) selectably retrieving a representation of the distance and the display position for one of the one or more markers and (b) transmitting the representation of the distance and the display position to the display for display of the distance and the marker at the display position.

2. The apparatus of claim 1 wherein:

the programmer further includes a second marker program means, responsive to user input commands received from the user input device, for: (a) selecting a second display position of a second marker associated with the one of the one or more markers and (b) storing second information from which a representation of the second display position can be retrieved; and the runner further comprises a second marker run means, responsive to the user input commands received from the user input device, for: (c) retrieving a representation of the second display position of the second marker associated with the one of the one or more markers and (d) transmitting the representation of the second display position to the display for display of the second marker at the second display position.

3. The apparatus of claim 2 wherein:

the program means for selecting a distance comprises means for: (a) increasing the distance and transmitting a representation of the increased distance to the display; and (b) decreasing the distance and transmitting a representation of the decreased distance to the display; and the program means for selecting a display position comprises means for: (c) increasing the display position and transmitting a representation of the increased display position to the display and (d) decreasing the display position and transmitting a representation of the decreased display position to the display.

4. The apparatus of claim 3 wherein:

the program means for selecting a second display position comprises means for: (a) increasing the second display position and transmitting a representation of the increased second display position to the display and (d) decreasing the second display position and transmitting a representation of the decreased second display position to the display.

5. The apparatus of claim 4 wherein:

the program means for storing information comprises means for storing information from which a representation of the distance can be retrieved using a representation of the display position.

6. The apparatus of claim 4 wherein:

the program means for storing information comprises means for storing information from which a representation of the display position can be retrieved using a representation of the distance.

7. The apparatus of claim 5 wherein:

the second marker program means for storing further information comprises means for storing further information from which a representation of the second display position can be retrieved using a representation of the display position.

8. The apparatus of claim 6 wherein:

the second marker program means for storing further information comprises means for storing further information from which a representation of the second display position can be retrieved using a representation of the distance.

9. The apparatus of claim 7 wherein:

the run means for selectably retrieving comprises means for: (a) increasing the display position and retrieving a representation of the distance using a representation of the increased display position and (b) decreasing the display position and retrieving a representation of the distance using a representation of the decreased display position.

10. The apparatus of claim 9 wherein:

the second marker run mean for retrieving comprises means for (a) retrieving the second display position using a representation of the display position.

11. The apparatus of claim 2 wherein the controller further comprises a deactivater and an activater; wherein:

the deactivater comprises a deactivate means, responsive to a user input deactivate command received from the user input device, for (a) transmitting a deactivate signal to the display and (b) retaining a representation of the displayed distance, display position, and second display position; and the activater comprises activater means, responsive to a user input activate command received from the user input device, for transmitting, to the display, the retained representation of the distance, display position, and second display position.

12. The apparatus of claim 11 wherein the display comprises a numeric display for displaying the distance, a first LED for displaying the marker, and a second LED for displaying the second marker.

13. A method for operating a target sight and rangefinder for a bow which comprises the steps of:

responsive to user input commands:

(a) selecting a target distance for one of one or more target markers, (b) selecting a display position of the one of the one or more target markers for the target distance, (c) selecting a range display position of a range marker corresponding to the one of the one or more target markers, and (d) storing information from which a representation of the target distance, the display position and the range display position can be retrieved; and responsive to user input commands:

(e) selecting one of the display positions, (t) retrieving a representation of a target distance and a range display position associated with the selected display position, and (g) displaying the target distance, a target marker at the display position, and a range marker at the range display position.

14. The method of claim 13 which further comprises the steps of:

responsive to a user input deactivate command:

(a) deactivating a display, and (b) retaining a representation of the displayed target distance, display position of the displayed target marker, and range display position of the displayed range marker; and responsive to a user input activate command (c) displaying the target distance, the target marker and the range marker of the retained representation.

* * * * *